US006976460B2

(12) United States Patent
Komazawa et al.

(10) Patent No.: US 6,976,460 B2
(45) Date of Patent: Dec. 20, 2005

(54) VARIABLE VALVE TIMING CONTROL DEVICE

(75) Inventors: Osamu Komazawa, Chita (JP); Naoto Yumisashi, Anjo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/786,539

(22) Filed: Feb. 26, 2004

(65) Prior Publication Data

US 2005/0016481 A1 Jan. 27, 2005

(30) Foreign Application Priority Data

Feb. 26, 2003 (JP) ..... 2003-049245

(51) Int. Cl.[7] ..... F01L 1/34

(52) U.S. Cl. ..... 123/90.15; 123/90.17; 464/160

(58) Field of Search ..... 123/90.15, 90.16, 123/90.17, 90.18, 90.27, 90.31; 464/1, 2, 464/160

(56) References Cited

U.S. PATENT DOCUMENTS 6,523,511 B2 * 2/2003 Hase ..... 123/90.17
6,647,936 B2 * 11/2003 Lewis ..... 123/90.17
6,684,835 B2 * 2/2004 Komazawa et al. ..... 123/90.17
6,779,499 B2 * 8/2004 Takenaka et al. ..... 123/90.17
2002/0038637 A1 4/2002 Kanada et al.
2002/0043231 A1 4/2002 Hase
2002/0092489 A1 7/2002 Mikame et al.

FOREIGN PATENT DOCUMENTS

DE 19959187 A1 6/2001
EP 1 357 260 A2 10/2003
JP 2002-97912 A 4/2002

* cited by examiner

*Primary Examiner*—Thomas Denion
*Assistant Examiner*—Ching Chang
(74) *Attorney, Agent, or Firm*—Buchanan Ingersoll PC

(57) ABSTRACT

A variable valve timing control device which includes a driving side rotational member, a driven side rotational member, a rotational phase holding mechanism for holding a relative rotational phase between the driving side rotational member and the driven side rotational member at a locked phase, a rotational phase restriction mechanism for allowing and restricting the relative rotation, a groove formed at one of the rotational members, a restriction body provided at the rotational phase restriction mechanism for restricting the relative rotation, a plurality of said rotational phase restriction mechanisms for restricting the relative rotation in a predetermined direction at different relative rotational phases, a step portion provided at the groove being engaged with the restriction body for restricting the relative rotation in the predetermined direction, and the rotational phase restriction mechanism including the step portion for restricting the relative rotation in the predetermined direction at the plural relative rotational phases.

14 Claims, 10 Drawing Sheets

VARIABLE VALVE TIMING CONTROL DEVICE

This application is based on and claims priority under 35 U.S.C. § 119 with respect to Japanese Patent Application No. 2003-049245 filed on Feb. 26, 2003, the entire contents of which are incorporated herein by reference.

FIELD OF THE INVENTION

The present invention relates to a variable valve timing control device. More particularly, the present invention pertains to a variable valve timing control device variably controlling a relative rotational phase between a driving side rotational member and a driven side rotational member and restricting a relative rotation between the driving side rotational member and the driven side rotational member.

BACKGROUND OF THE INVENTION

Known variable valve timing control devices ensure appropriate operational state of an engine by varying relative rotational phases of a driving side rotational member such as an external rotor rotating synchronized with a crankshaft and a driven side rotational member such as an inner rotor connected with a camshaft at a normal operation of the engine.

The known variable valve timing control devices include a rotational phase holding mechanism (i.e., a lock mechanism) for holding and allowing the relative rotation between the driving side rotational member and the driven side rotational member. The lock mechanism maintains a lock release state when changing the relative rotational phase. A locked state is, for example, achieved at timing for ensuring a predetermined relative rotational phase such as at an engine start.

In other words, the lock mechanism assumes a locked position at the engine start and assumes a lock release position at a normal operation. Thus, the appropriate starting state is ensured at the engine start.

The lock mechanism includes a lock body moving from the first rotational member side to enter the second rotational member side (i.e., of either the driving side rotational member or the driven side rotational member). By the lock body extended both in the first and the second rotational members, the locked position for holding the relative rotation is achieved. In the meantime, by the retraction of the lock body to the first rotational member side, the relative rotation between the first rotational member and the second rotational member is allowed to assume the lock release position.

A known variable valve timing control device includes a rotational phase restriction mechanism for restricting the relative rotation between the driving side rotational member and the driven side rotational member separating from a locked phase and for allowing the relative rotation between the driving side rotational member and the driven side rotational member approximating to the locked phase by the construction between a restriction body (i.e., corresponding to the lock body of the lock mechanism) and a groove width of a groove formed at the rotational member for receiving the restriction body to be extended in the peripheral direction.

The rotational phase restriction mechanism restricts the relative rotation to a retarded angle side and allows the relative rotation to an advanced angle side at a restriction phase determined, for example, between a most retarded angle phase and the locked phase in case the locked phase is determined at an intermediate phase region between the most retarded angle phase and a most advanced angle phase. With the restriction by the rotational phase restriction mechanism, the relative rotation between the driving side rotational member and the driven side rotational member does not move to the retarded angle side equal to or further than the restriction phase.

A known variable valve timing control device described in Japanese Patent Laid-Open Publication No. 2002-97912 includes the rotational phase restriction mechanism. With the rotational phase restriction mechanism of the variable valve timing control device described in Japanese Patent Laid-Open Publication No. 2002-97912, an engine start lock operation for locking by changing the relative rotational phase from the most retarded angle phase to the locked phase at the engine start is performed swiftly.

With the construction of the variable valve timing control device described in Japanese Patent Laid-Open Publication No. 2002-97912, the rotational phase change from the most retarded angle phase to the locked phase corresponding to the intermediate advanced angle is carried out with steps by one-fourth phase of the phase differences between the most retarded angle phase and the locked phase by providing an auxiliary restriction mechanism serving as the rotational phase restriction mechanism.

The variable valve timing control device described in Japanese Patent Laid-Open Publication No. 2002-97912 includes a rotational phase holding mechanism including a first control mechanism and a second control mechanism. The rotational phase holding mechanism further includes the single auxiliary restriction mechanism. A lock groove includes a step serving as the auxiliary restriction mechanism.

With the variable valve timing control device described in Japanese Patent Laid-Open Publication No. 2002-97912, the reaching time to the locked phase is shortened by raising the level of an initial value of the relative rotation by a predetermined value by providing the mechanism for restricting the relative rotation to the retarded angle direction during the relative rotation from the phase before the engine start (e.g., the most retarded angle) to the locked phase serving as the intermediate phase by the fluctuation torque applied to a camshaft (shown in FIG. 13).

Notwithstanding, with the construction of the known variable valve timing control device described in Japanese Patent Laid-Open Publication No. 2002-97912, the reaching time to the locked phase assumes long at the low temperature environment due to the increase of the resistance when draining the remained oil in a fluid chamber used for adjusting the relative rotational phase to reduce the relative rotational width due to the fluctuation torque of the camshaft.

A need thus exists for a variable valve timing control device which achieves a swift and secure engine start lock with a simple construction.

SUMMARY OF THE INVENTION

In light of the foregoing, the present invention provides a variable valve timing control device which includes a driving side rotational member rotating synchronized with a crankshaft, a driven side rotational member positioned coaxially with the driving side rotational member, the driven side rotational member rotating with a camshaft, a rotational phase holding mechanism for holding a relative rotational phase between the driving side rotational member and the driven side rotational member at a locked phase, a rotational phase restriction mechanism for allowing a relative rotation that the relative rotational phase approximate to the locked phase and for restricting the relative rotation that the relative rotational phase being separated from the locked phase, a groove formed at one of the driving side rotational member and the driven side rotational member, a restriction body provided at the rotational phase restriction mechanism for restricting the relative rotation by moving from the other of the driving side rotational member and the driven side rotational member to be received at the groove, a plurality of said rotational phase restriction mechanisms for restricting the relative rotation in a predetermined direction at different relative rotational phases, a step portion provided at the groove serving as a part of at least one of the rotational phase restriction mechanisms being engaged with the restriction body for restricting the relative rotation in the predetermined direction, and the rotational phase restriction mechanism including the step portion for restricting the relative rotation in the predetermined direction at the plural relative rotational phases.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

Figure 4A:
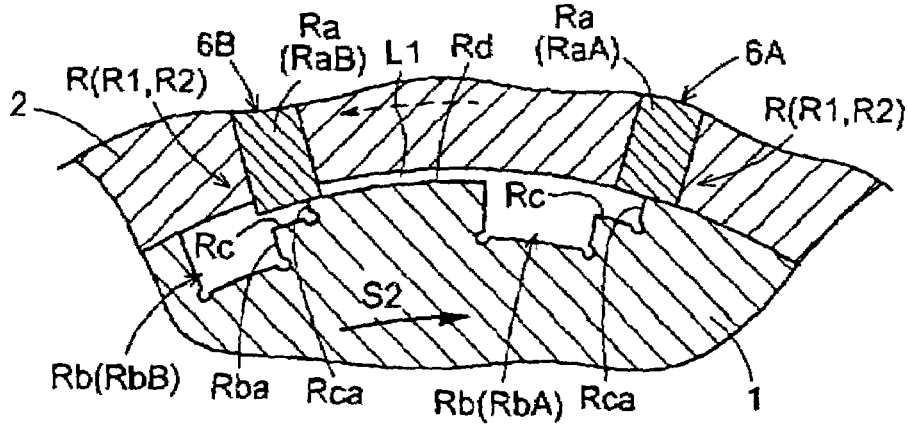

FIG. 4*a* is an explanatory view of a stepwise restriction by a rotational phase restriction mechanism according to the first embodiment of the present invention.

Figure 4B:
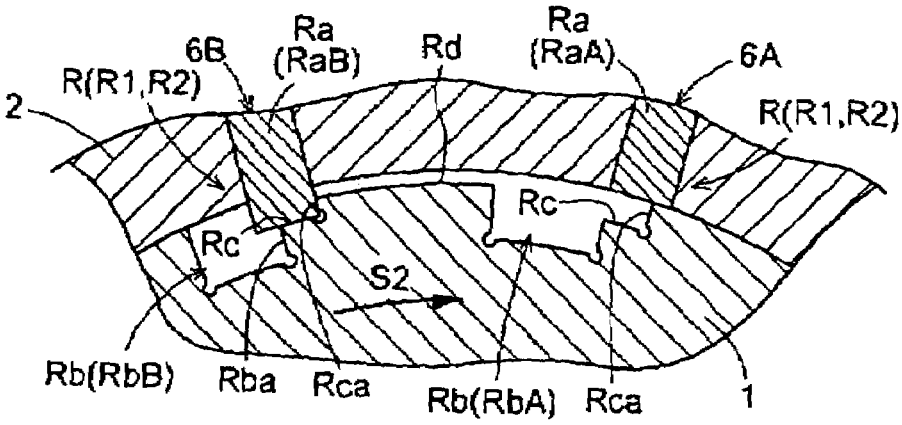

FIG. 4*b* is an explanatory view of the stepwise restriction by the rotational phase restriction mechanism according to the first embodiment of the present invention.

Figure 4C:
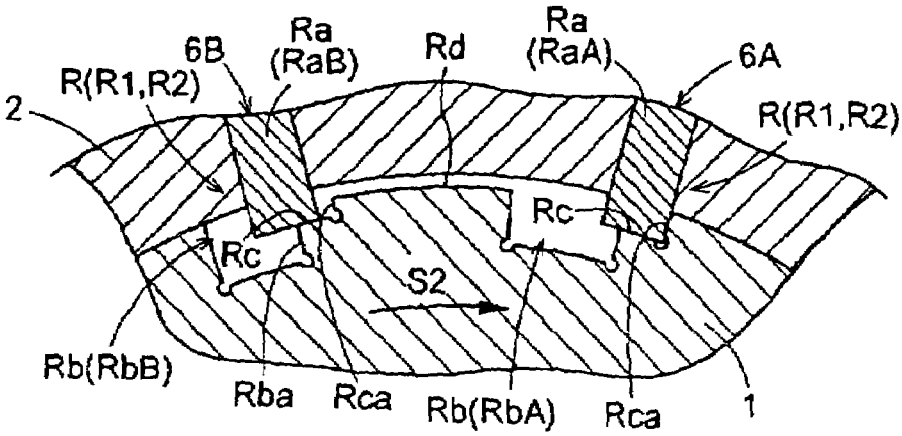

FIG. 4*c* is an explanatory view of the stepwise restriction by the rotational phase restriction mechanism according to the first embodiment of the present invention.

Figure 5A:
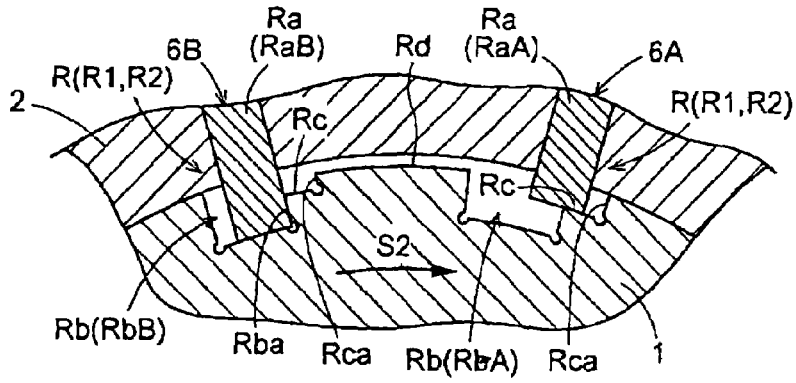

FIG. 5*a* is an explanatory view of the stepwise restriction by the rotational phase restriction mechanism according to the first embodiment of the present invention.

Figure 5B:
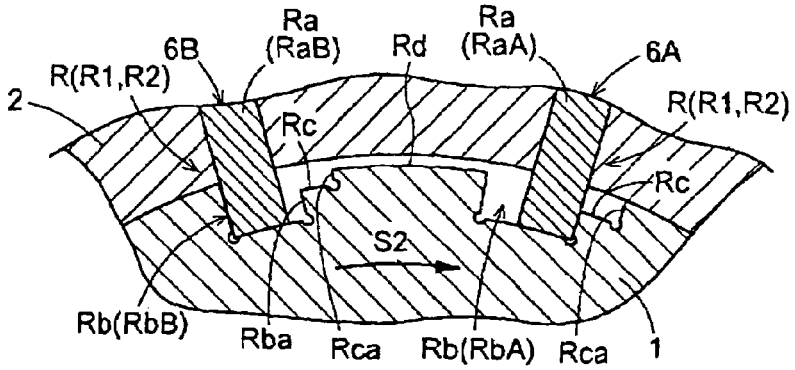

FIG. 5*b* is an explanatory view of the stepwise restriction by the rotational phase restriction mechanism according to the first embodiment of the present invention.

Figure 6:
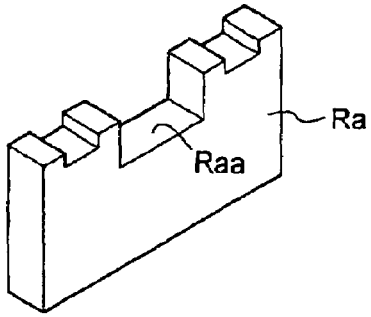

FIG. 6 is a perspective view of a moving body according to the first embodiment of the present invention.

Figure 7:
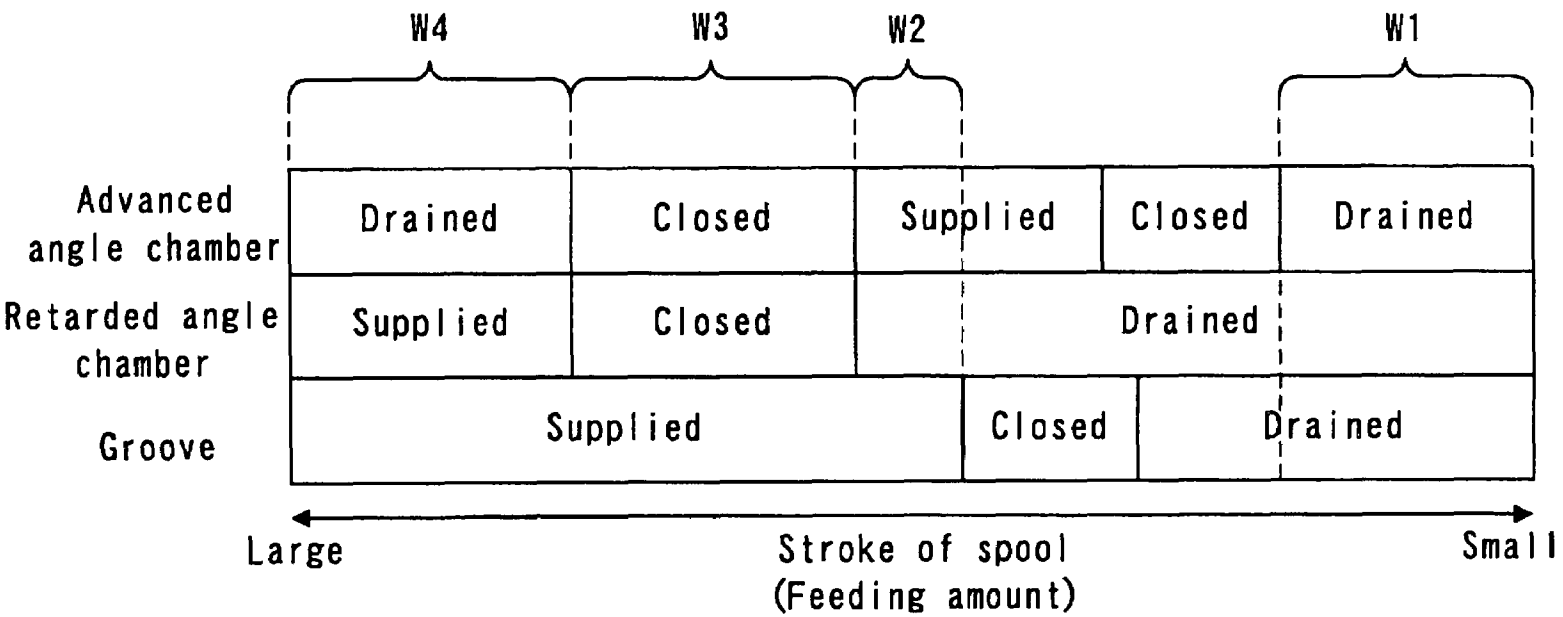

FIG. 7 is a view showing an operational construction of an oil control valve according to the first embodiment of the present invention.

Figure 8A:
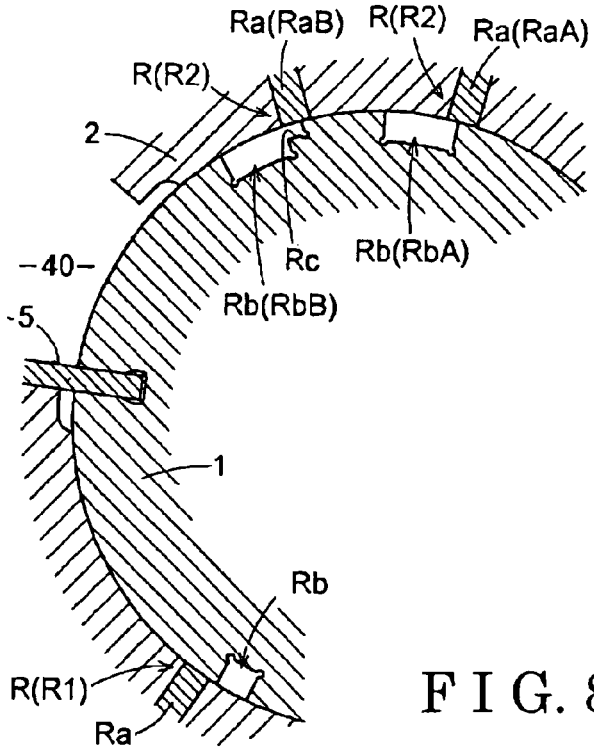

FIG. 8*a* is an operational explanatory view of a variable valve timing control device including an independent rotational phase holding mechanism according to a second embodiment of the present invention.

Figure 8B:
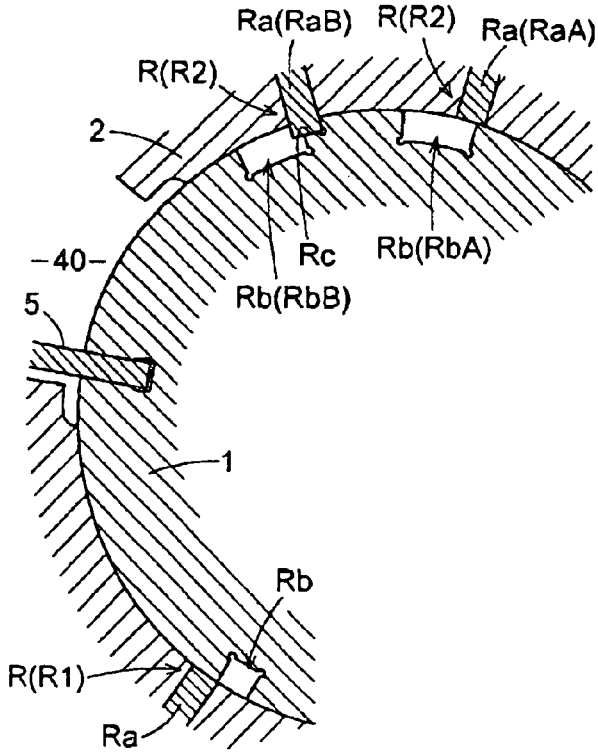

FIG. 8*b* is an operational explanatory view of the variable valve timing control device including the independent rotational phase holding mechanism according to the second embodiment of the present invention.

Figure 9A:
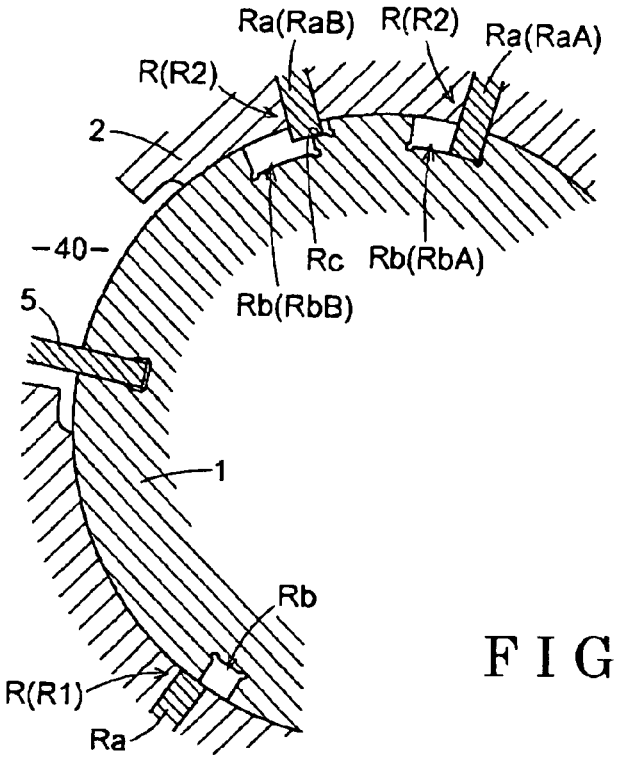

FIG. 9*a* is an operational explanatory view of the variable valve timing control device including the independent rotational phase holding mechanism according to the second embodiment of the present invention.

Figure 9B:
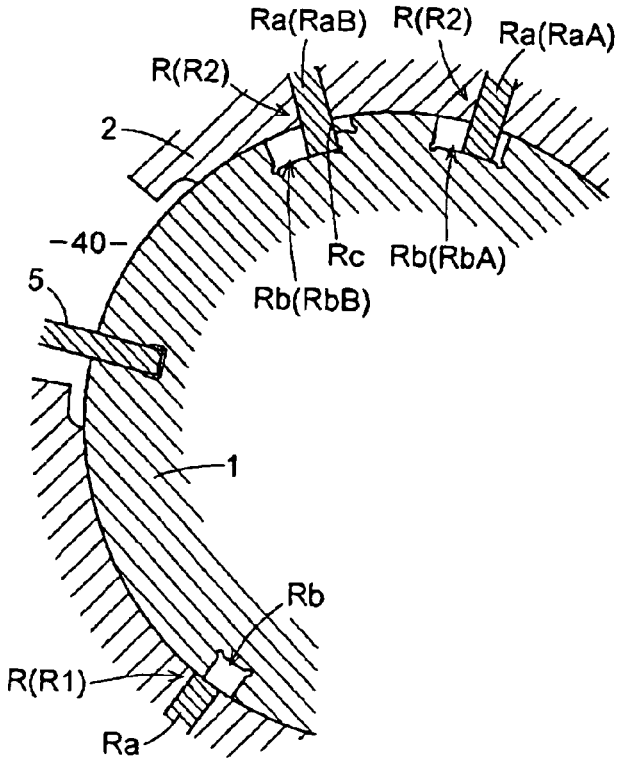

FIG. 9*b* is an operational explanatory view of the variable valve timing control device including the independent rotational phase holding mechanism according to the second embodiment of the present invention.

Figure 10:
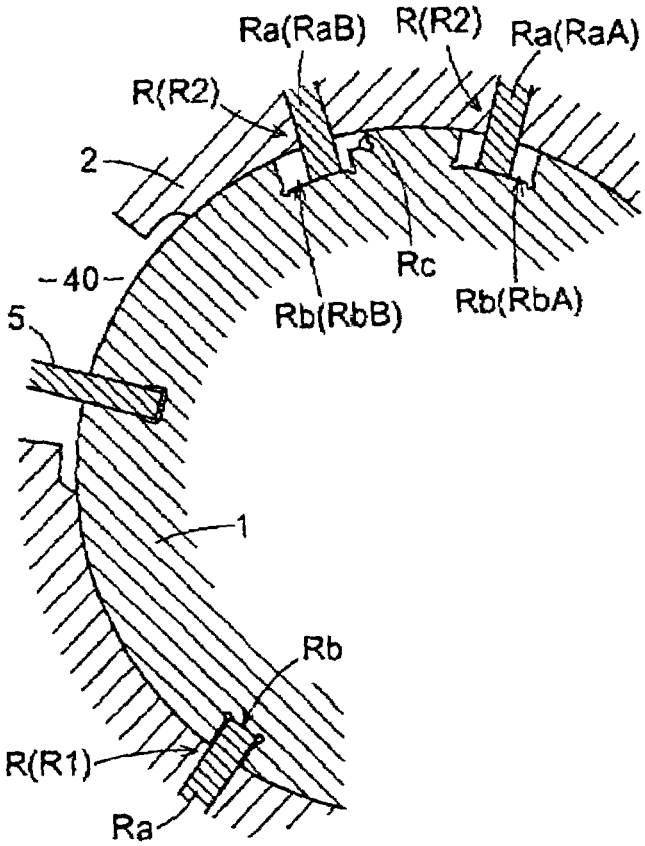

FIG. 10 is an explanatory view of the variable valve timing control device including the independent rotational phase holding mechanism according to the second embodiment of the present invention.

Figure 11:
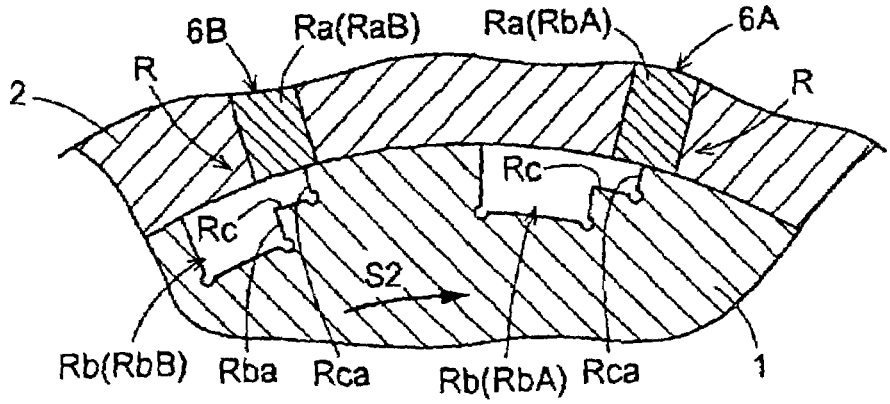

FIG. 11 is a view showing a main portion without a guiding passage according to a further embodiment of the present invention.

Figure 12:
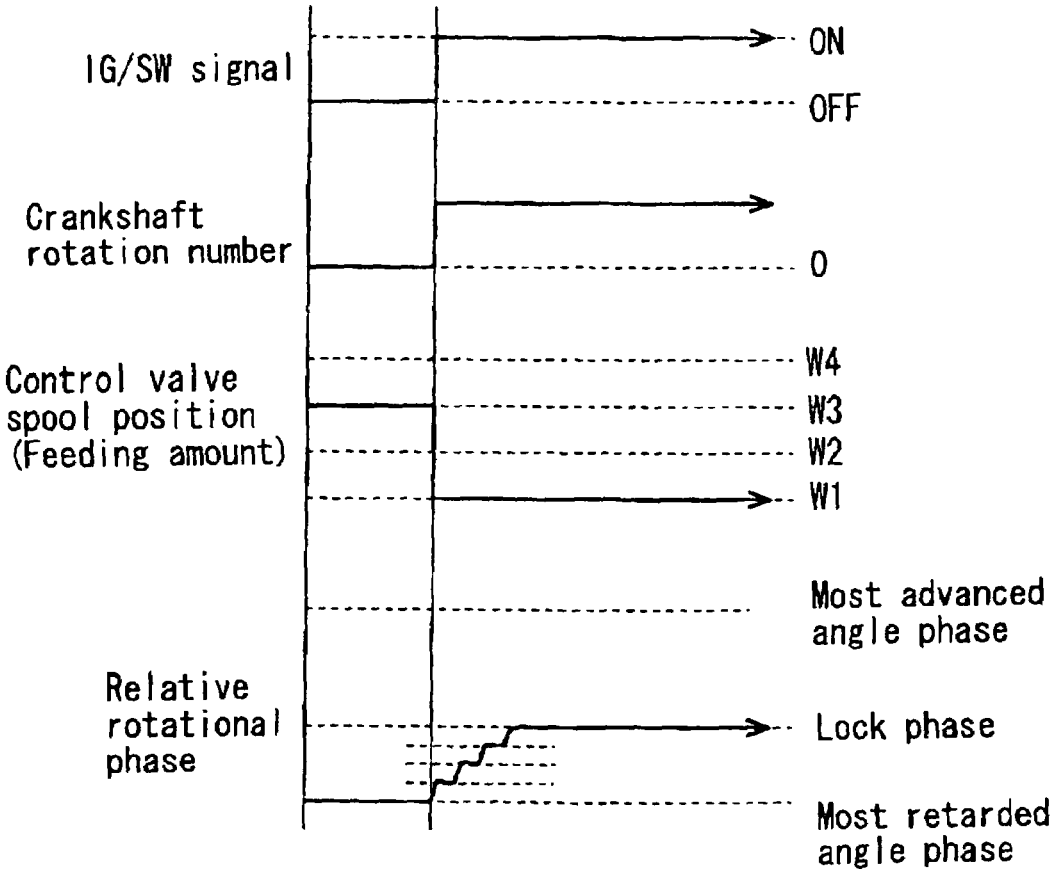

FIG. 12 is a timing chart showing a control state of the variable valve timing control device at the engine start.

Figure 13:
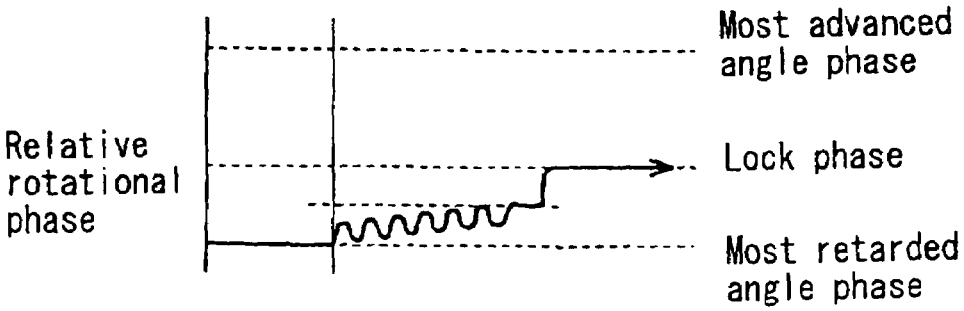
FIG. 13 Prior Art

FIG. 13 is a view showing a control of a known variable valve timing control device.

DETAILED DESCRIPTION OF THE INVENTION

Embodiments of the present invention will be explained with reference to the illustrations of the drawing figures as follows. A first embodiment of the present invention will be explained with reference to FIGS. 1–7 and FIG. 12.

Figure 1:
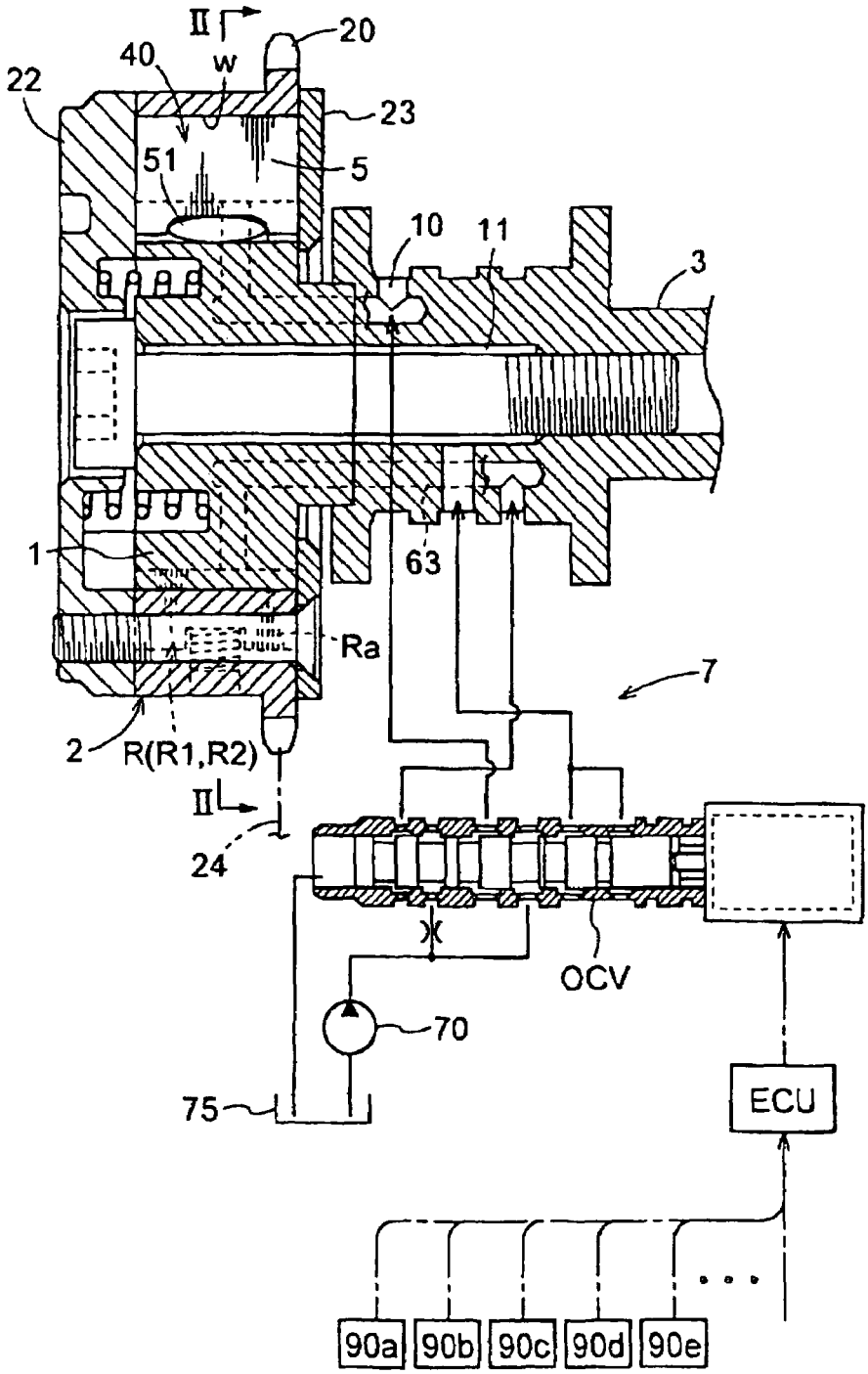
FIG. 1 shows a lateral sectional view of a variable valve timing control device according to a first embodiment of the present invention.

Basic construction of the variable valve timing control device will be explained as follows. As shown in FIG. 1, the variable valve timing control device includes an external rotor 2 serving as a driving side rotational member rotating synchronized with a crankshaft of a combustion engine for an automobile and an internal rotor 1 serving as a driven side rotational member positioned coaxially with the external rotor 2 for unitarily rotating with a camshaft 3.

The internal rotor 1 is unitarily assembled at a tip end portion of the camshaft 3 to be unitarily rotated with the camshaft supported by a cylinder head of the combustion engine.

The external rotor 2 is outfitted at the internal rotor 1 to be relatively rotating within a predetermined range of a relative rotational phase and provided with a front plate 22, a rear plate 23 and a timing sprocket 20 unitarily provided at an external periphery of the external rotor 2.

A power transmission member 24 such as a timing chain and a timing belt is provided between the timing sprocket 20 and a gear provided at the crankshaft of the engine.

When the crankshaft of the engine rotationally drives, the rotational power is transmitted to the timing sprocket 20 via the power transmission member 24 to rotate the external rotor 2 including the timing sprocket 20 in a rotational direction S (shown in FIG. 2) and to rotate the internal rotor 1 in the rotational direction S. The rotation of the internal rotor 1 rotates the camshaft 3. Thereafter, a cam provided at the camshaft 3 pushes an intake valve or an exhaust valve to open the intake valve or the exhaust valve.

Figure 2:
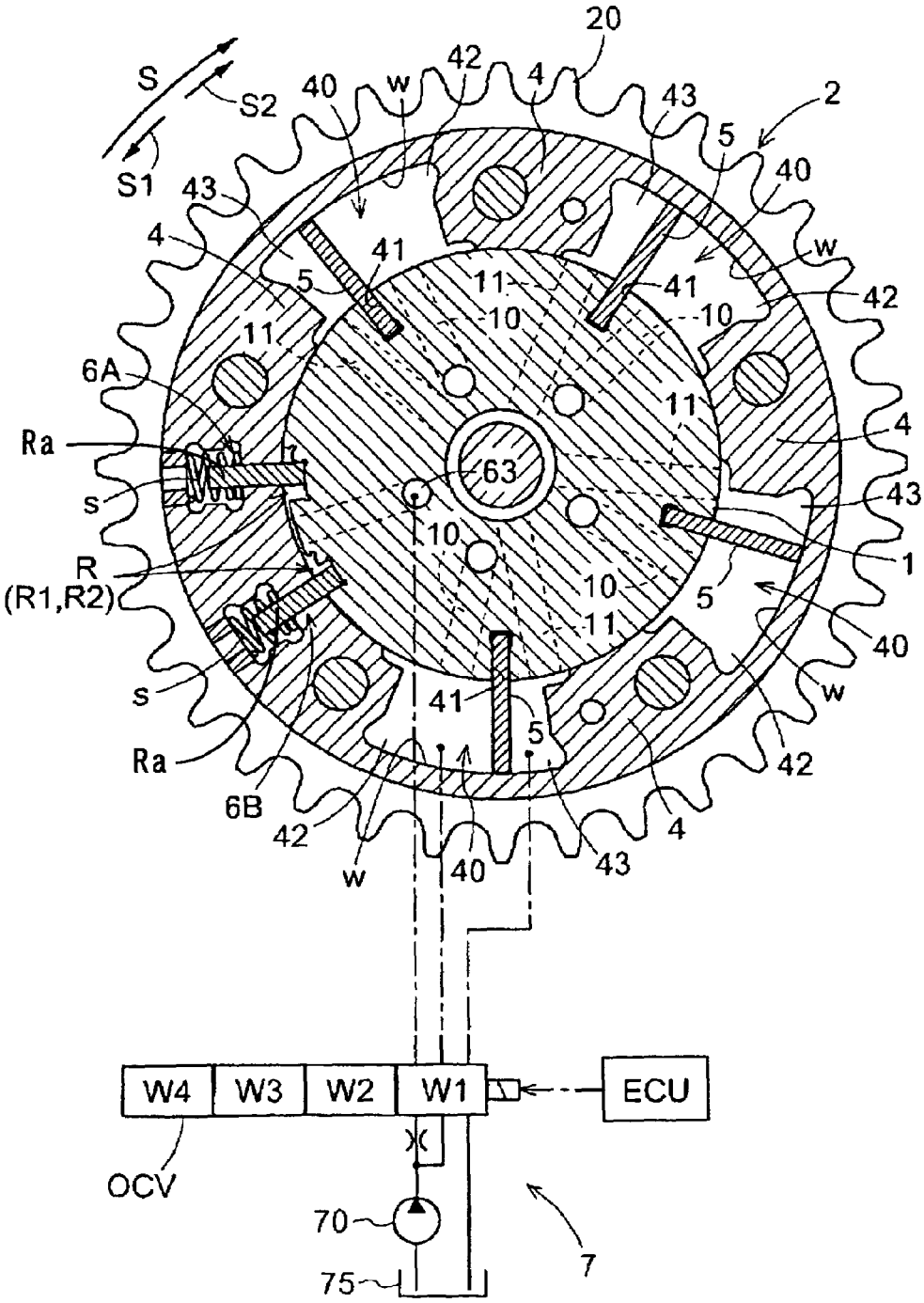
FIG. 2 shows a cross-sectional view of the variable valve timing control device at a locked state taken on line II—II of FIG. 1.

A construction of a rotational phase adjusting mechanism will be explained as follows. As shown in FIG. 2, the external rotor 2 includes plural projections 4 serving as shoes projecting in a radially inward direction along a rotational direction keeping a predetermined interval from each other. Fluid pressure chambers 40 defined by the external rotor 2 and the internal rotor 1 are formed between adjacent projections 4 of the external rotor 2.

Vane grooves 41 are formed at an external periphery portion of the internal rotor 1 facing respective fluid pressure chambers 40. A vane 5 is provided in the vane groove 41 for dividing the fluid pressure chamber 40 to define an advanced angle chamber 43 and a retarded angle chamber 42 in a relative rotational direction (i.e., S1, S2 directions of FIG. 2). The vane 5 is arranged in the vane grooves 41 to slide in a radial direction. As shown in FIG. 1, the vane 5 is biased towards a fluid pressure chamber internal wall surface W side by a spring 52 provided at radially internal side thereof.

The advanced angle chamber 43 is in communication with an advanced angle passage 11 formed at the internal rotor 1. The retarded angle chamber 42 is in communication with a retarded angle passage 10 formed at the internal rotor 1. The advanced angle passage 11 and the retarded angle passage 10 are connected with a hydraulic pressure circuit 7.

A rotational phase holding mechanism R1 is provided between the internal rotor 1 and the external rotor 2 for holding the relative rotation between the internal rotor 1 and the external rotor 2 when the relative rotational phase is at a predetermined locked phase (e.g., phases shown in FIGS. 2–3) determined between a most advanced angle phase and a most retarded angle phase. The rotational phase holding mechanism R1 includes a pair of rotational phase holding/restricting mechanism R for restricting a rotation in a particular rotational direction and in a reverse direction of the particular direction. The lock function is achieved with the pair of rotational phase holding/restricting mechanisms R, R by restricting the rotation in the different directions with each rotational phase holding/restricting mechanism R.

As shown in FIG. 4, the rotational phase holding/restricting mechanism R includes a moving body Ra for slidingly moving in the rotational phase holding/restricting mechanism R and a groove Rb for receiving the moving body Ra to be engaged. In case the lock function is achieved, the moving body Ra serves as a lock body and the groove Rb serves as a lock groove. In case the restriction function is achieved, the moving body Ra serves a restriction body and the groove Rb serves as a restriction groove.

Figure 3:
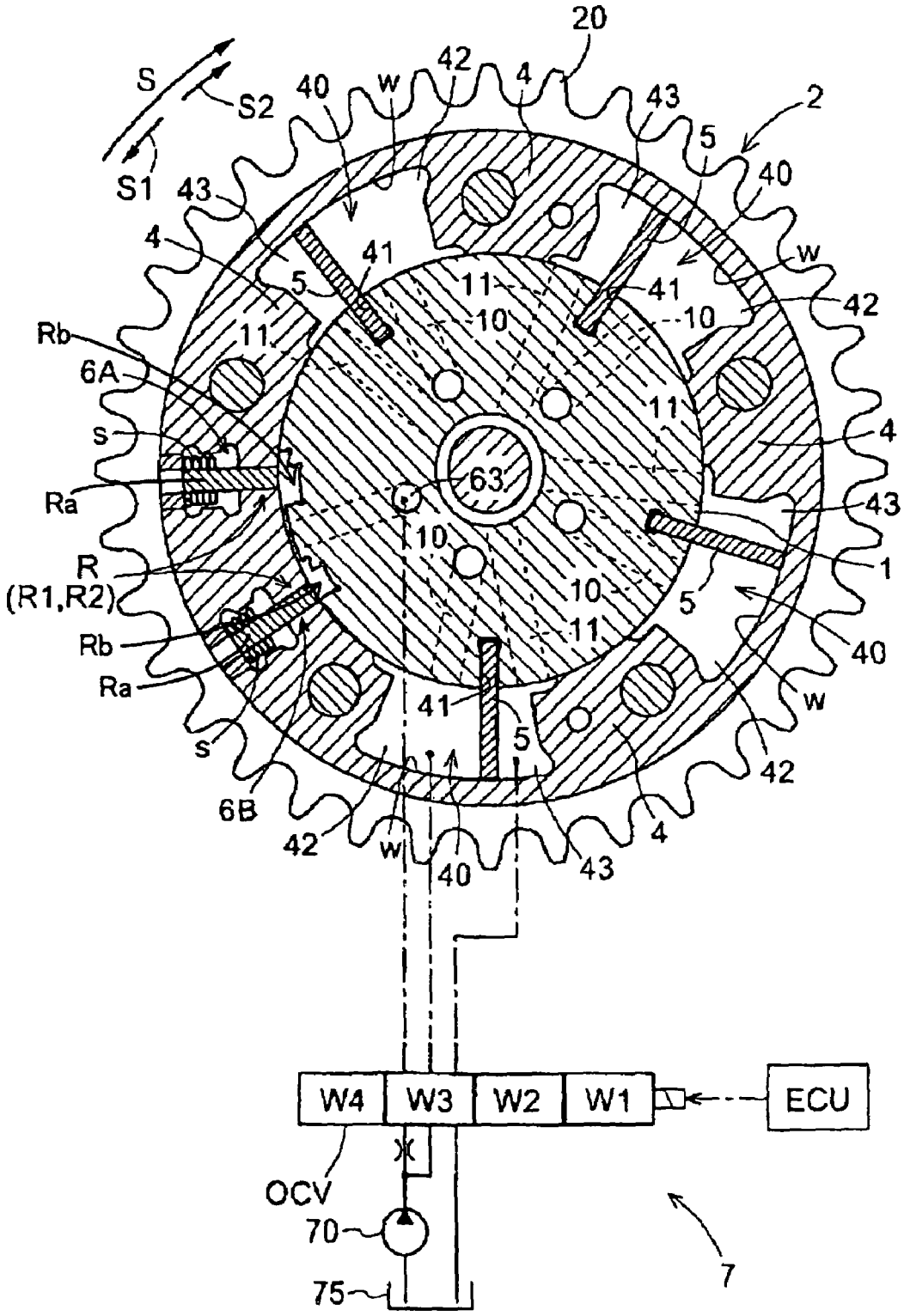
FIG. 3 shows a cross sectional view of the variable valve timing control device at a lock release state according to the first embodiment of the present invention.

As shown in FIGS. 2–3, the rotational phase holding mechanism R1 includes the pair of rotational phase holding mechanisms R, R at a predetermined portion. As shown in FIGS. 2–3, the rotational phase holding mechanism R1 includes a retarded angle lock portion 6A and an advanced angle lock portion 6B provided at the external rotor 2, and a pair of recessed grooves Rb, Rb (i.e., the grooves RbA, RbB) at an external peripheral portion of the internal rotor 1.

As shown in FIGS. 2, 3, 6, the rotational phase holding/restricting mechanism R includes the moving body Ra provided at the external rotor 2 slidably in the radial direction and a spring S serving as a mechanical biasing means for biasing the moving body Ra in the radially inward direction. The spring S is fitted in a recess portion Raa of the moving body Ra for biasing the moving body Ra to the radially internal direction from the external rotor 2 side.

Although the moving body Ra includes a plate configuration in the embodiment shown in FIGS. 2, 3, 6, the moving body Ra may include a pin type configuration, or the like.

At the locked phase where the rotational phase holding mechanism R1 functions, as shown in FIGS. 2, 5*b*, the moving bodies Ra, Ra for the retarded angle lock portion 6A and the advanced angle lock portion 6B are fitted in grooves RbA, RbB, respectively to achieve the locked state for holding the relative rotational phase between the internal rotor 1 and the external rotor 2 at the predetermined locked phase determined between the most advanced angle phase and the most retarded angle phase. The state of the rotational phase holding/restricting mechanism R at the foregoing state is defined as a locked status. The locked phase is determined at a phase where the valve timing can achieve the smooth engine start.

As foregoing, a pair of the rotational phase holding restricting mechanism R serves as the rotational phase holding mechanism R1. In the meantime, respective rotational phase holding/restricting mechanisms R serve as rotational phase restriction mechanisms R2.

The rotational phase holding mechanism R1 approximately completely stops the relative rotation at the locked phase. In the meantime, the rotational phase restriction mechanism R2 restricts the return of the relative rotation in a direction being away from the locked phase (e.g., retarded angle side) with a stepwise manner at the relative rotation in a predetermined direction that the relative rotational phase moves to the locked phase. The rotational phase restriction mechanism R2 allows the relative rotation towards the locked phase (e.g., advanced angle rotation).

As foregoing, with the construction of the variable valve timing control device of the embodiment, the locking function of the rotational phase holding mechanism R1 including the retarded angle lock portion 6A and the advanced angle lock portion 6B is achieved by the moving bodies Ra, Ra fitted in the grooves Rb, Rb respectively by contacting walls of the grooves Rb, Rb, the walls positioned at different rotational direction sides from each other. In the meantime, in order to achieve the restriction function, the lock function is used for the restriction function at the retarded angle lock portion 6A. With the advanced angle lock portion 6B, as shown in FIGS. 4*b*, 5*a*, retarded angle side groove sidewall Rba of the groove Rb is positioned at a unique position to be used for the restriction function (i.e., the sidewall Rba does not function for locking). Further, a step portion Rc is provided at the retarded angle side groove sidewall Rba of the groove Rb, which provides a characteristic at the position in the peripheral direction (i.e., the phase serving for the restriction of the rotational phase).

As shown in FIG. 4, the step portion Rc is provided at the retarded angle side of respective grooves Rb. The step portion Rc is configured to receive and to be engaged with the moving body Ra. By the receipt and the engagement of the moving body Ra at the step portion Rc, the relative rotation towards the retarded angle side is restricted and the relative rotation towards the advanced angle side is allowed at respective rotational phases. In other words, the rotational restriction direction for the moving body Ra at a step portion sidewall Rca and the groove sidewall Rba is identical.

As shown in FIGS. 4*a*, 4*c*, 5*a*, the phases are predetermined so that the restriction is applied to the step portion Rc provided at an advanced angle groove RbB, the step portion Rc provided at a retarded angle groove RbA, and a deep portion of the advanced angle groove RbB in order.

More particularly, as shown in the relative rotational phase of FIG. 12, the relative rotation towards the retarded angle direction is restricted by three steps. Accordingly, the moving body Ra is engaged with the groove Rb stepwise in accordance with the rotation of the crankshaft to raise the level of the initial value of the relative rotation.

Further, in order to ensure the reception of the moving body Ra into the groove Rb, a guiding passage Rd is provided.

With the embodiment shown in FIGS. 2–5, the raising the level of the initial value of the relative rotation is achieved in accordance with the relative rotation from the retarded angle side to the locked phase. The guiding passage Rd for guiding the moving body Ra is formed at a surface position of the internal rotor 1 facing an approximate moving path L1. The guiding passage Rd is positioned at further groove side compared to a surface position of the internal rotor 1 facing a path extended from the approximate moving path L1 beyond the groove Rb. The guiding passage Rd is provided closer to the groove by approximately 0.1 mm.

By providing the guiding passage Rd, the moving body Ra can be securely guided in the groove Rb including the step portion Rc. Because a tip end of the moving body Ra in the moving direction contacts the groove sidewall RbB positioned opposing to the rotating moving body Ra when the moving body Ra reaches over the groove Rb, the moving body Ra securely enters the groove Rb.

The moving body Ra enters the groove Rb by the biasing force of the spring S at a state that the oil supplied in the groove Rb via the hydraulic pressure circuit 7 is drained. The moving body Ra is retracted from the groove Rb at a state that the oil is supplied to the groove Rb via the hydraulic pressure circuit 7. The state of the rotational phase holding/restricting mechanism R in the foregoing state is defined as a lock release state.

The supply and the discharge of the lock oil control the operation of the rotational phase holding/restricting mechanism R. In this case, the relative position between the external rotor 2 and the internal rotor 1 has to be at the locked phase for the locking.

The supply and the discharge of the operational oil will be explained as follows. As shown in FIGS. 1–3, the hydraulic pressure circuit 7 supplies and discharges the oil serving as the operation fluid relative to the advanced angle chamber 43 and the retarded angle chamber 42 via the advanced angle passage 11 and the retarded angle passage 10 for adjusting the relative rotational phase between the external rotor 2 and the internal rotor 1 between the most advanced angle phase (i.e., the relative rotational phase when the advanced angle chamber 43 assumes the maximum volume) and the most retarded angle phase (i.e., the relative rational phase when the retarded angle chamber 42 assumes the maximum volume) by changing the relative position of the vane 5 in the hydraulic pressure chamber 40.

Further, the hydraulic pressure circuit 7 carries out the lock operation and the lock release operation of the rotational phase holding/restricting mechanism R, which is necessary for carrying out the relative rotational phase setting.

As shown in FIGS. 1–3, the hydraulic pressure circuit 7 includes a pump 70 driven by the driving force of the engine or the electric power for supplying the operation fluid or the oil serving as the lock oil to an oil control valve OCV side, the solenoid type oil control valve OCV for supplying and discharging the oil at plural ports by varying the position of a spool by controlling the electric supply amount by an electronic control unit ECU, and an oil pan 75 for reserving the oil.

The advanced angle passage 11 and the retarded angle passage 10 are connected to the predetermined port of the oil control valve OCV.

The groove Rb is in communication with a lock oil passage 63 formed at the internal rotor 1. The lock oil passage 63 is connected to the predetermined port at the oil control valve OCV of the hydraulic pressure circuit 7.

In other words, the hydraulic pressure circuit 7 supplies and discharges the oil serving as the lock oil to the groove Rb via the lock oil passage 63. When the lock oil is supplied to the groove Rb from the oil control valve OCV, as shown in FIG. 3, the moving body Ra retracts to the external rotor 2 side to release the locked state of the relative rotation between the external rotor 2 and the internal rotor 1.

As shown in FIG. 7, the oil control valve OCV of the hydraulic pressure circuit 7 varies the position of the spool from a position W1 to a position W4 being proportional to the feeding from the electronic control unit ECU to switch the supply, the drain, and the stop of the oil serving as the lock oil or the operation fluid relative to the advanced angle chamber 43, and the retarded angle chamber 42, and the groove Rb.

By positioning the spool of the oil control valve OCV at the position W1, the drain operation where the operation fluid of the advanced angle chamber 43 and the retarded angle chamber 42 and the lock oil of the groove Rb are drained to the oil pan 75 side.

By positioning the spool of the oil control valve OCV at the position W2, the lock oil is supplied to the groove Rb to release the locked state of the relative rotation between the external rotor 2 and the internal rotor 1. Further, the advanced angle moving operation for moving the relative rotational phase between the external rotor 2 and the internal rotor 1 towards the advanced angle direction S2 by supplying the operation fluid to the advanced angle 43 while draining the operation fluid of the retarded angle 42 can be carried out.

By positioning the spool of the oil control valve OCV at the position W3, the locked state of the relative rotation between the external rotor 2 and the internal rotor 1 is released while stopping the supply of the operation fluid to the advanced angle chamber 43 and the retarded angle chamber 42 to maintain the relative rotational phase between the external rotor 2 and the internal rotor 1 (i.e., maintaining operation).

By positioning the spool of the oil control valve OCV at the position W4, the locked state of the relative rotation between the external rotor 2 and the internal rotor 1 is released, and the operation fluid is supplied to the retarded angle chamber 42 while draining the operation fluid of the advanced angle chamber 43 to move the relative rotational phase between the external rotor 2 and the internal rotor 1 towards the retarded angle direction S1 (i.e., retarded angle moving operation). The operation construction of the oil control valve OCV is not limited to the foregoing construction and maybe varied.

The electronic control unit ECU provided at the engine includes a memory including predetermined programs, or the like, a CPU, and an input-output interface.

As shown in FIG. 1, the electronic control unit ECU is connected with a cam angle sensor 90*a* for detecting the phase of the camshaft, a crank angle sensor for detecting the phase of the crankshaft, an oil temperature sensor 90*c* for detecting the temperature of the engine oil, a rotation number sensor 90*d* for detecting the rotation number of the crankshaft (i.e., engine rpm), and an IG key switch (i.e., referred as IG/SW hereafter) 90*e*. The detected signals from the sensors 90*a*–90*e* and other sensors such as a vehicle speed sensor, a cooling water temperature sensor of the engine, and throttle opening sensor, or the like is inputted into the electronic control unit ECU.

The electronic control unit ECU can obtain the relative rotational phase between the camshaft and the crankshaft from the phase of the camshaft detected at the cam angle sensor 90*a* and the phase of the crankshaft detected at the crankshaft angle sensor 90*b*, i.e., the relative rotational phase between the internal rotor 1 and the external rotor 2 of the variable valve timing control device.

The electronic control unit ECU controls the relative rotational phase between the internal rotor 1 and the external rotor 2 to be suitable for the operational state by adjusting the feeding to the oil control valve OCV of the hydraulic pressure circuit 7 based on the temperature of the engine oil, the rotational number of the crankshaft, the vehicle speed, and the operational state of the engine such as the throttle opening, or the like.

The start lock control of the variable valve timing control device at the engine start will be explained based on FIGS. 2–5.

The electronic control unit ECU starts the engine by cranking (i.e., compulsorily rotating the crankshaft by a starter) the crankshaft when the input signal is inputted from the IG/SW 90*e*. At the engine start, the operation fluid of the advanced angle chamber 43 and the retarded angle chamber 42 and the lock oil of the groove Rb are drained by positioning the spool of the oil control valve OCV at the position W1.

At the engine start, the relative rotational phase is at the most retarded angle phase as shown in FIG. 12. In the foregoing state, as shown in FIG. 4*a*, the pair of moving bodies Ra is at the lock release position to be biased towards the internal rotor 1 by the spring S. As shown in FIG. 4*a*, only the moving body RaB for the advanced angle contacts the surface of the guiding passage Rd.

By cranking the crankshaft while the operation fluid of the advanced angle chamber 43 and the retarded angle chamber 42 is drained, the vane 5 reciprocates by the periodic cam fluctuation torque generated for opening and closing the valve at the cam shaft in the hydraulic pressure chamber 40. Thus, the relative rotational phase between the internal rotor 1 and the external rotor 2 is periodically fluctuated to the locked phase side.

In other words, the relative rotational phase periodically fluctuates to increase moving towards the advanced angle side while biasing the moving body Ra to the internal rotor 1 side. At this stage, as shown in FIGS. 4*b*, 12, the advanced angle moving body RaB fits in the step portion Rc provided at the advanced angle groove RbB at the first periodic fluctuation so that the advanced angle moving body RaB receives the phase rotational restriction of the retarded angle side.

By the consecutive rotation of the crankshaft, the fluctuation starts from the foregoing restriction phase. As shown in FIG. 4*c*, the retarded angle moving body RaA fits in the step portion Rc provided at the retarded angle groove RbA by the consecutive periodic fluctuation so that the retarded angle moving body RaA receives the phase rotational restriction of the retarded angle side.

Further, as shown in FIG. 5*a*, the advanced angle moving body RaB fits in the advanced angle groove RbB in accordance with the unit fluctuation to restrict the rotational phase.

Likewise, as shown in FIG. 5*b*, the retarded angle moving body RaA fits in the retarded angle groove RbA to receive the rotational phase restriction thereafter. Thus, the transition to the locked phase is completed.

As foregoing, a pair of the moving bodies Ra, Ra fits in the corresponding grooves Rb, Rb, respectively to achieve the locked state where the relative rotational phase is favorably held at the locked phase.

By swiftly performing the locking of the relative rotational phase to the locked phase at the engine start as foregoing, the favorable engine start can be achieved.

After starting the engine at the locked state, the relative rotational phase control can be carried out following the operational state of the engine.

A second embodiment of the present invention will be explained as follows. In the construction of the first embodiment, the rotational phase holding mechanism R1 and the rotational phase restriction mechanism R2 are achieved by a pair of the rotational phase holding/restricting mechanisms R, R. In the construction of the second embodiment, an independent mechanism including the relative rotational holding function at the lock side is provided.

The operation of the variable valve timing device including an independent rotational phase holding mechanism R1 is shown in FIGS. 8–9. As shown in FIGS. 8–9, with the construction of the second embodiment, the width of the groove Rb receiving the moving body Ra of the rotational phase restriction mechanism R2 is extended in the peripheral direction. More particularly, the width of the retarded angle groove RbA in the peripheral direction is extended in the retarded angle side and the width of the advanced angle groove RbB in the peripheral direction is extended in the advanced angle side. Thus, with the construction of the second embodiment, the moving body Ra is not locked at the step portion Rc provided relative to the groove Rb and at the groove Rb per se. Further, the step portion Rc is provided only at the advanced angle groove RbB and is not provided at the retarded angle groove RbA.

With the construction of the second embodiment, the rotational phase holding mechanism R1 is constructed with the single rotational phase holding/restricting mechanism R at the rotational phase position where the lock should be achieved.

As shown in FIGS. 8*b*, 9*a*, 9*b*, in this case, the advanced angle moving body RaB fits in the step portion Rc provided at the advanced angle restriction groove RbB first, the retarded angle restriction body RaA fits in the retarded angle restriction groove RbA thereafter, and the advanced angle moving body RaB fits in the advanced angle restriction groove RbB for the desired restriction. Thereafter, in accordance with the rotation of the camshaft, the moving body Ra provided at the independent rotational phase holding mechanism R1 achieves the lock (shown in FIG. 10).

Although the desired stepwise restriction is applied by including a pair of the rotational phase holding/restricting mechanisms R, R as the rotational phase restriction mechanisms R2 respectively, the number of the rotational phase holding/restricting mechanism R is not limited to one pair. Likewise, the number of the rotational phase restriction mechanism R2 with the step portion is not limited to the single number.

The embodiments of the present invention may include plural rotational phase restriction mechanisms R2 and a pat of or the all of the rotational phase restriction mechanisms R2 may include the step portion. The order of the portion functioning for the restriction is not limited for stepwise restriction of the rotation in a particular direction. However, the restriction phase difference in the same mechanism can be large by restricting the rotation in order between different rotational phase restriction mechanisms R2.

Although the restriction is applied in order at the rotational phase where the restriction is applied in order every periodic fluctuation in accordance with the rotation of the camshaft, the restriction (i.e., the raising the level of the initial value of the relative rotation by a step) may be applied via the periodic fluctuation of the plural camshaft rotations between the restricted rotational phases.

Although the raising the level of the initial value of the relative rotation by three steps is achieved with approximately the same rotational phase differences as shown in the relative rotational phase of FIG. 12 in the embodiments, the different rotational phases difference may be determined for plural steps in order to determine a lock with relatively small fluctuation width at initial state and locks with gradually increasing fluctuation widths as the elapse of time considering the start lock.

Although the start intermediate lock is explained in the embodiment, with the variable valve timing control device in which the rotational phase restriction mechanism operates to approximate to the locked phase and to be away from the locked phase, at least one rotational phase restriction mechanism with step is provided and the stepwise restriction may be applied by providing the plural rotational phase restriction mechanisms. In other words, the lock timing may be at the start lock or the stop lock, or the like, and the lock position may be intermediate position, the most advanced angle position, the most retarded angle position, or the like to adopt the stepwise restriction construction.

Although the advanced angle moving body RaB contacts the guiding passage Rd in the embodiment, the guiding passage Rd may be removed. The depth of the guiding passage Rd may be determined to be slightly longer than the value adding a C portion in case the C portions are provided at the bottom end of the moving body and the surface side end of the groove Rd respectively.

Although the moving body Ra moves from the external rotor at the driving side positioned at the outside to the internal rotor at the driven side to lock and restrict for constructing the rotational phase holding/restricting mechanism R with the embodiments, the moving direction of the moving body is not limited to the radially rotational direction perpendicular to the rotational shaft and may be the moving direction in parallel with the rotational shaft or may be moving in the diagonal direction for the lock and the restriction. Further, the moving body Ra may move from the driving side to the driven side for the lock and the restriction or in the reverse direction for the lock and restriction.

According to the embodiments of the present invention, the rotational phase restriction in the different directions with plural steps in particular directions such as the advanced angle direction and the retarded angle direction by providing the plural rotational phase restriction mechanisms. Thus, the stepwise raising the level of the initial value of the relative rotation can be achieved in the identical direction to shorten the reaching time until reaching the predetermined locked phase to the minimum.

Further, according to the embodiments of the present invention, with the at least one rotational phase restriction mechanisms with the step portion, the restriction is achieved at the plural different rotational phases. The restriction body is engaged with the step portion to achieve the restriction. With this construction, for example, the restriction is achieved at different relative phase positions including at least two states, for example, the state that the restriction body completely fits in the groove and the state that the restriction body fits in the step portion. This construction achieves the raising the level of the initial value of the relative rotation by the multiple steps with a compact construction, and the raising the level of the initial value of the relative rotation by the plural steps can be achieved without increasing the size of the variable valve timing control device per se. The step portion may include the single step portion. The step portion may include the stepwise step portion including multiple steps functioning at the different relative rotational phases.

According to the embodiments of the present invention, the rotational phase holding mechanism is constructed with the plural rotational phase restriction mechanism. In order to achieve the relative rotational holding (locking), it is required to restrict the relative rotation at the pair of reverse directions in the relative rotational direction (i.e., the pair of the reverse directions include the retarded angle direction and the advanced angle direction). Thus, by providing the portion for restricting the relative rotation (e.g., the step portion or the groove deep portion) in the direction necessary for the raising the level of the initial value of the relative rotation at one of the mechanism for holding the relative rotation at the retarded angle side and the mechanism for holding the relative rotation at the advanced angle side, the plural rotational phase restriction mechanisms share the function of the rotational phase holding mechanism. This achieves the variable valve timing control device with simple construction while achieving the holding and the restriction functions.

With the construction of the embodiments of the present invention, the mechanism includes the restriction body moving in the radial direction of the rotational member. In this case, an axis of the restriction body can be arranged in the radial direction. For example, the influence of the centrifugal force generated in accordance with the rotation of the rotational member is evenly received by an elastic member in the axial direction as the compression force compared to the case the moving direction is determined in the parallel direction relative to the rotational axis of the rotational member. Thus, the stable mechanism can be achieved and the engagement at the restriction can be securely achieved simultaneously.

According to the embodiments of the present invention, the rotational phase restriction mechanism includes the rotational phase restriction mechanism including the groove and the restriction body fitting into a deepest portion of the groove, the rotational phase restriction mechanism including the step portion, and the rotational phase restriction mechanism including the step portion for achieving the restriction with the plural steps. By restricting the relative rotation in the predetermined direction to approximate to the locked phase the restriction is achieved at different rotational phase restriction mechanisms in order.

In this case, the number of the relative rotational phase can be reduced for the particular rotational phase restriction mechanism. Thus, the construction which is easy for machining and assumes the stable operational state can be obtained. Accordingly, the swift and stable rotational phase restriction can be achieved by raising the level of the relative rotational phase by multiple steps.

According to the embodiments of the present invention, the restriction at the plural steps can be achieved by providing the plural (i.e., at least a pair of) rotational phase restriction mechanisms. Further, by providing the step portion at the rotational phases and by configuring the step portion to be engaged with the restriction body alternately, the difference of the different rotational phases served by the respective rotational phase restriction mechanism can be large. Accordingly, in case the restriction is achieved stepwise, the phase differences can be determined large with the construction of the respective rotational phase restriction mechanisms. Thus, the machining of the groove including the step can be easy and accurate and the mechanism with high reliability can be achieved with a compact construction.

With the construction of the embodiments of the present invention, in case the restriction at the different relative rotational phases is achieved stepwise in accordance with the rotation of the camshaft with the rotational phase restriction mechanism for achieving the stepwise restriction in the same direction at the different relative rotational phases, the reaching time reaching to the locked phase can be shortened. The reaching time to the locked phase shown in FIG. 12 is reduced by one-third compared to the reaching time of the known device shown in FIG. 13.

According to the embodiments of the present invention, the restriction body fitting into the groove can achieve the desired restriction. By providing the guiding passage to configure the surface position of the rotational member at the path at the approximate moving side deeper than the surface position of the rotational member at the extended path side beyond the groove, the end portion of the restriction body at the moving direction tip end side moved over the groove can be securely contacted to the groove wall, thus, to securely receive the restriction body to the groove. This ensures the stable operation of the restriction body.

According to the embodiments of the present invention, the raising the level of the initial value of the relative rotation is achieved by engaging the restriction body to the groove or the step portion provided at the groove in order. At the initial step, the probability of the entrance of the restriction body to the groove or the step portion may decrease. Once the restriction is achieved at one of the plural restriction bodies, the raising the level of the initial value of the relative rotation can be favorably achieved in order. By providing the guiding passage at one of the rotational phase restriction mechanism (i.e., the rotational phase restriction mechanism used at the initial state is favorable), the restriction body can be securely received at the groove or the step portion. In this case, the necessary machining can be reduced.

Further, in case a pair of the rotational phase restriction mechanisms is provided, the initial operation of the restriction mechanism can be achieved securely by providing the guiding passage at the intermediate position. More particularly, the initial operation of the restriction mechanism can be achieved securely by contacting the restriction body of one of the rotational phase restriction mechanisms to the guiding passage at the initial stage and by contacting the restriction body of the other mechanism to the surface portion deviated from the intermediate portion of the two rotational phase restriction mechanisms.

The principles, preferred embodiment and mode of operation of the present invention have been described in the foregoing specification. However, the invention which is intended to be protected is not to be construed as limited to the particular embodiments disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A variable valve timing control device, comprising:

a driving side rotational member rotating synchronized with a crankshaft;

a driven side rotational member positioned coaxially with the driving side rotational member, the driven side rotational member rotating with a camshaft; a rotational phase holding mechanism for holding a relative rotational phase between the driving side rotational member and the driven side rotational member at a locked phase;

a rotational phase restriction mechanism for allowing a relative rotation that the relative rotational phase approximate to the locked phase and for restricting the relative rotation that the relative rotational phase being separated from the locked phase;

a groove formed at one of the driving side rotational member and the driven side rotational member;

a restriction body provided at the rotational phase restriction mechanism for restricting the relative rotation by moving from the other of the driving side rotational member and the driven side rotational member to be received at the groove;

a step portion provided at the groove serving as a part of at least one of the rotational phase restriction mechanisms being engaged with the restriction body for restricting the relative rotation in the predetermined direction;

the rotational phase restriction mechanism including the step portion for restricting the relative rotation in the predetermined direction at the plural relative rotational phases;

wherein the rotational phase restriction mechanism includes a first rotational phase restriction mechanism and a second rotational phase restriction mechanism serving as a pair of rotational phase restriction mechanisms; and wherein the relative rotational restriction is consecutively applied at different relative rotational phases in order of the step portion of the first rotational phase restriction mechanism, the step portion of the second rotational phase restriction mechanism, and the groove portion configured to be deeper than the step portion of the first rotational phase restriction mechanism.

2. The variable valve timing control device according to claim 1, wherein the rotational phase holding mechanism includes the plural rotational phase restriction mechanisms.

3. The variable valve timing control device according to claim 1, wherein the groove is formed at said the other of the driving side rotational member and the driven side rotational member in a radial direction so that the restriction body moves in the radial direction to be received at the groove.

4. The variable valve timing control device according to claim 1, wherein the relative rotational restriction is applied in order by the different rotational phase restriction mechanisms for stepwise restricting the relative rotation in the predetermined direction at the plural different relative rotational phases.

5. The variable valve timing control device according to claim 1, the rotational phase restriction mechanism for applying the stepwise restriction at different relative rotational phases in the same direction; wherein the rotational phase restriction mechanism applies the stepwise restriction at the different relative rotational phases in accordance with a rotation of the camshaft.

6. The variable valve timing control device according to claim 1, wherein the restriction body moves at a path to approximate to over the groove to be received at the groove, further comprising:

a guiding passage for guiding the restriction body, the guiding passage provided at a first rotational member surface position at the path, the first rotational member surface position determined at further groove inside than a second rotational member surface position provided at an extended path extended from said path.

7. The variable valve timing control device according to claim 6, wherein the guiding passage is provided at an intermediate position between a pair of rotational phase restriction mechanisms.

8. The variable valve timing control device according to claim 6, wherein the grooves are provided at the first rotational phase restriction mechanism and the second rotational phase restriction mechanism respectively; and wherein the guiding passage is provided at one of the grooves side receiving the restriction body at an initial stage.

9. The variable valve timing control device according to claim 1, wherein the step portion is configured stepwise.

10. The variable valve timing control device according to claim 1, wherein each rotational phase restriction mechanism includes the step portion.

11. A variable valve timing control device according to claim 1, wherein the plural relative rotational phases determined by restricting the relative rotation includes varied rotational phase differences different from one another.

12. A variable valve timing control device according to claim 11, wherein the rotational phase difference is varied from a small phase difference at an initial state to be increased in order.

13. A variable valve timing control device, comprising:

a driving side rotational member rotating synchronized with a crankshaft;

a driven side rotational member positioned coaxially with the driving side rotational member, the driven side rotational member rotating with a camshaft; a rotational phase holding mechanism for holding a relative rotational phase between the driving side rotational member and the driven side rotational member at a locked phase;

a rotational phase restriction mechanism for allowing a relative rotation that the relative rotational phase approximate to the locked phase and for restricting the relative rotation that the relative rotational phase being separated from the locked phase;

a groove formed at one of the driving side rotational member and the driven side rotational member;

a restriction body provided at the rotational phase restriction mechanism for restricting the relative rotation by moving from the other of the driving side rotational member and the driven side rotational member to be received at the groove;

a step portion provided at the groove serving as a part of at least one of the rotational chase restriction mechanisms being engaged with the restriction body for restricting the relative rotation in the predetermined direction;

the rotational phase restriction mechanism including the step portion for restricting the relative rotation in the predetermined direction at the plural relative rotational phases;

wherein the restriction body moves at a path to approximate to over the groove to be received at the groove, further comprising:

a guiding passage for guiding the restriction body, the guiding passage provided at a first rotational member surface position at the path, the first rotational member surface position determined at further groove inside than a second rotational member surface position provided at an extended path extended from said path.

14. The variable valve timing control device according to claim 13, wherein the restriction body serving as a part of at least one of the rotational phase restriction mechanisms contacts a surface of the guiding passage to move to approximate to over the groove; wherein the plural rotational phase restriction mechanisms include the restriction body respectively.

* * * * *